US009381671B2

(12) United States Patent
Deering

(10) Patent No.: US 9,381,671 B2
(45) Date of Patent: Jul. 5, 2016

(54) FORM LINER WITH BACKER PANEL

(71) Applicant: Spec Formliners, Inc., Santa Ana, CA (US)

(72) Inventor: Andrew Deering, San Juan Capistrano, CA (US)

(73) Assignee: SPEC FORMLINERS, INC., Santa Ana, CA (US)

( * ) Notice: Subject to any disclaimer, the term of this patent is extended or adjusted under 35 U.S.C. 154(b) by 0 days.

(21) Appl. No.: 14/743,553

(22) Filed: Jun. 18, 2015

(65) Prior Publication Data

US 2016/0090748 A1 Mar. 31, 2016

Related U.S. Application Data

(60) Provisional application No. 62/057,400, filed on Sep. 30, 2014.

(51) Int. Cl.
*E04G 9/10* (2006.01)
*B28B 7/00* (2006.01)

(52) U.S. Cl.
CPC ..... *B28B 7/0073* (2013.01); *B28B 7/0064* (2013.01); *B28B 7/0082* (2013.01); *E04G 9/10* (2013.01)

(58) Field of Classification Search
CPC ..... E04G 9/10; B28B 7/0073; B28B 7/0064; B28B 7/0079; B28B 7/0082
USPC ..... 249/35, 112, 16; 428/184, 186
See application file for complete search history.

(56) References Cited

U.S. PATENT DOCUMENTS 884,166 A * 4/1908 Kemper ..... E04G 9/10 249/189
1,220,461 A * 3/1917 Rodgers ..... E04G 11/12 249/192
1,470,835 A * 10/1923 Hathaway ..... E04F 13/04 249/15
1,472,174 A * 10/1923 Hughes ..... E04G 11/10 249/192
1,802,522 A * 4/1931 Moll ..... B65D 65/403 428/186
2,272,659 A * 2/1942 Daley ..... E04G 15/068 249/193
2,523,713 A * 9/1950 Mortrude, Jr. ..... E04G 9/10 249/189
2,791,819 A * 5/1957 Carlsen ..... E04G 9/10 249/104
2,867,887 A * 1/1959 Bevan ..... B28B 7/06 249/112
3,458,168 A * 7/1969 White ..... E04G 9/10 249/176

(Continued)

*Primary Examiner* — Michael Safavi
(74) *Attorney, Agent, or Firm* — Kenny Nguyen; Eastman & McCartney LLP

(57) ABSTRACT

A structurally supportive backer panel formed to fit within the recesses of a form liner to support the form liner when casting textured surfaces into concrete. The backer panel has a series of protrusions which fit within the recesses of the form liner in order to prevent the concrete pressure from deflecting and buckling the form liner. When the wet concrete is poured into a form fitted with the backer panel and form liner, the concrete fills the form and contacts the form liner, wherein the backer panel ensures that the shape of the form liner is not affected by the pressure and weight of the concrete.

12 Claims, 7 Drawing Sheets

(56) References Cited

U.S. PATENT DOCUMENTS 3,664,630 A * 5/1972 Maynen et al. ..... E04G 9/10 249/112
3,756,904 A * 9/1973 Fredericks ..... B31B 3/00 428/101
3,780,977 A * 12/1973 Dashew ..... E04G 9/10 249/112
3,884,444 A * 5/1975 Dashew ..... E04G 9/10 249/112
4,017,051 A * 4/1977 Scott ..... E04G 13/04 249/115
4,695,033 A * 9/1987 Imaeda ..... E04B 5/40 249/112
4,798,364 A * 1/1989 Scott ..... B28B 7/346 249/112
4,886,696 A * 12/1989 Bainbridge ..... B31F 1/0009 181/284
5,074,517 A * 12/1991 Scott ..... E04G 9/05 249/112
7,452,589 B2 * 11/2008 Mossbeck ..... A47C 27/22 428/161
2007/0051865 A1 * 3/2007 Cooper ..... E04G 11/04 249/18

* cited by examiner

FORM LINER WITH BACKER PANEL

RELATED APPLICATION

This application claims the benefit of priority to U.S. Provisional Patent Application No. 62/057,400, entitled "Backer Panel for Formliners," filed Sep. 30, 2014 and currently copending.

FIELD OF INVENTION

The present invention relates generally to textured concrete surfaces. The present invention relates more particularly, though not exclusively, to the molds for producing textured concrete surfaces and support systems thereof.

BACKGROUND OF THE INVENTION

Due to the physical characteristics of concrete, including the ability to withstand strong compressive loads, concrete is often utilized as the building material of choice to create foundations, walls, floors and various other structures. Concrete is a composite material composed mainly of water, aggregate, and cement that when combined forms a fluid concrete mass. As the concrete cures, the cement forms a solid matrix binding all of the components together into a durable stone-like material. In its fluid state, concrete does not have the ability to hold or fake shape. Therefore, in the construction of concrete structures, temporary or permanent forms are utilized to give the concrete shape and form.

The forms generally consist of supports forming the perimeter of the structure with sheathing placed against the supports and on top of another to form the walls of the structure. Ties are used to space the sheathing apart and to hold them in piece. This creates the form with a cavity for the fluid concrete to be poured. After the form is complete, the fluid concrete is poured into the cavity and allowed to cure. For temporary forms, once the concrete has been cured the form is removed to expose the finished concrete. As a fluid mass, the concrete takes the shape of the mold as it cures, therefore more complex concrete structures may be constructed. In particular, concrete walls have been formed with aesthetically pleasing textured surfaces.

To construct the textured surfaces on concrete walls, form liners are inserted into the cavity of the forms and secured against the sheathing. The form liners provide an alternative surface to the flat surface of the sheathing in which the concrete cures and takes shape. As the concrete cures, it maintains the shape of the form liner. The form liners are used to create simple designs such as ridge, shiplap, simple shapes, and to more complex designs such as custom designs.

Form liners are generally made in large sections, such as 4-feet by 4-feet and made larger for custom applications. Due to its size, it is crucial to control the dimensions and weight of the form liner to allow an installer to adequately handle the form liner. Typically, form liners are constructed of plastic, elastomeric urethane, semi-elastomeric urethane, or any other material or combination of materials to keep weight low. The thickness of the form liner is minimized as an additional method of controlling weight. Due to the material, the design pattern, and the dimensions of the form liner, the form liners are susceptible to deflection due to the pressure created by the heavy concrete. The deflection of the form liners results in the finished concrete surface bulging further than what was designed or intended, resulting in designs exceeding the specification. This occurrence is usually undesired and can result in the necessity to demolish and re-pour the wall at great expense and time delay.

Currently, the remedy is to cut wood or foam shapes which fit within the voids between the form liner and the sheathing to provide support to counter the pressure of the concrete. This is a labor-intensive method and, in some cases, can cost more than the form liner used on the job. This defeats the purpose of using the form liner because a primary purpose of using a form liner is to repeat a pattern or design easily and quickly by placing textured sheets or panels adjacent to one another in a form without having to actually perform work on every square foot of wall to be poured.

In light of the above, it would be advantageous to provide a form liner system capable of withstanding the pressures of poured concrete in forms without deformation. It would further be advantageous to provide a backer panel having protrusions for use with form liners to support the axial loads on the form liner to prevent deflection. It would be further advantageous to provide a form liner system which Is transportable, easy to handle and easy to assemble.

BRIEF SUMMARY OF THE INVENTION

The present invention is a form liner backer panel system for use in concrete forms for producing textured concrete surfaces. The invention is designed to act as a support system for the backside of form liners made of plastic, elastomeric urethane, semi-elastomeric urethane, or any other material or combination of materials. A problem exists when using formed or molded sheets or panels of form liners having unsupported areas of pattern is that they are not supported by the form. The pressure of the concrete poured against the form liner can cause deflection of the form liner in these unsupported areas. The resulting concrete surface wiil have imperfections due to the bulge in these unsupported areas by the amount of the deflection of the form liner. These imperfections are often more significant in the lower portion of a wall or concrete structure due to the higher pressure exerted by the weight of the concrete. The finished wall is thus not built to specifications of the project design. The present invention solves this problem when placed between the backside of a form liner and the sheathing by supporting the unsupported areas with a series of protrusions by way of flutes, ridges, or other means specific to the pattern of form liner used.

The present invention includes a form liner and a backer panel. In a preferred embodiment, the form liner has a sawtooth wave pattern having a plurality of sawtooth sections and the backer panel has a protrusion pattern formed to fit within the saw wave pattern of the form liner. The backer panel includes a plurality of protrusion sections, with each protrusion section having a plurality of protrusions configured to occupy a corresponding recess defined by a sawtooth section of the form liner. The plurality of protrusion sections of the backer panel are configured to fit within the recesses of the form liner, where the backer panel fits flush to create the form liner backer panel system for forming textured concrete surfaces.

The backer panel provides structural support to the form liner to prevent the form liner from buckling and deflecting due to the excessive pressure of the poured concrete. The backer panel serves as protrusions to support the horizontal members of the sawtooth wave pattern of the form liner. The backer panel provides a plurality of vertical members capable of withstanding higher forces before buckling compared to the forces required for the horizontal members of the form liner to deflect. The backer panel supports the force on the form liner and transfers the force through the backer panel to the sheathing of the form system. The sheathing and support of the form system has higher rigidity and structural strength compared to the form liner and the backer panel, and thus is able to easily withstand the pressures of the concrete. The formation of the form liner and backer panel with a plurality of corresponding recesses results in a lightweight product relative to the volume occupied.

The form liner and backer panel support system is further configured to be compact and easily transportable. The form liner and backer panel are two distinct pieces which mount to form the form liner backer panel system for use. When not in use, the form liner and backer panels may be separated. By separating the form liner and backer panel from each other, each form liner is able to be stacked on top of another and each backer panel is able to be stacked on top of another as well. The form liners and backer panels used for a particular job may be stacked for compact storage and transport. Also, by separating the form liner and backer panel, the weight of any individual piece is reduced for easier handling.

In various alternative embodiments, the form liner pattern may be varied and include, but not limited to, fluted patterns, fin patterns, brick patterns, block patterns, wood grain patterns, textured patterns and other custom patterns. The backer panel pattern will be formed to provide a plurality of protrusions formed to conform to the pattern of the form liner to provide structural support to prevent the form liner from buckling and deflecting. The backer panel pattern may be made of various shapes such as cylindrical, tubular, triangular, spherical, conical, hexagonal pyramids or any other shape which may be utilized to provide a structure to support multidimensional forces.

DETAILED DESCRIPTION OF THE DRAWINGS

Figure 1:
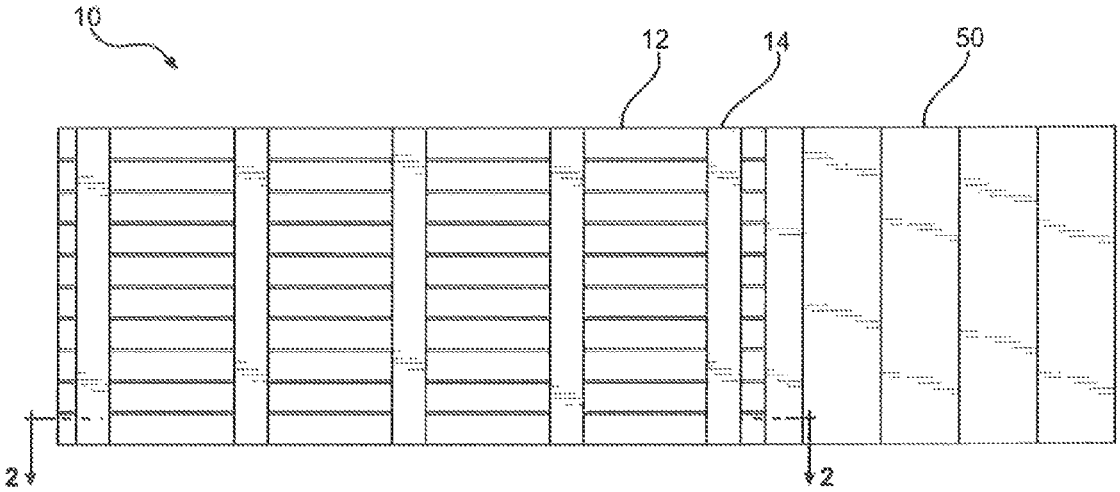
FIG. 1 Prior Art
FIG. 1 is a front elevation view of a prior art form used to construct a concrete wall with a sawtooth pattern.

Referring initially to FIG. 1, a prior art form system used to create a concrete wall 50 is shown and generally designated 10. The form system 10 includes a plurality of supports 14 inserted into a ground to form a rough perimeter outline of the concrete wall. Inserted between and attached to the supports 14 is a plurality of sheathing 12. The sheathing 12 is stacked upon one another to form a mold with four walls. Concrete is poured into the mold to form a wall having relatively flat surfaces.

Figure 2:
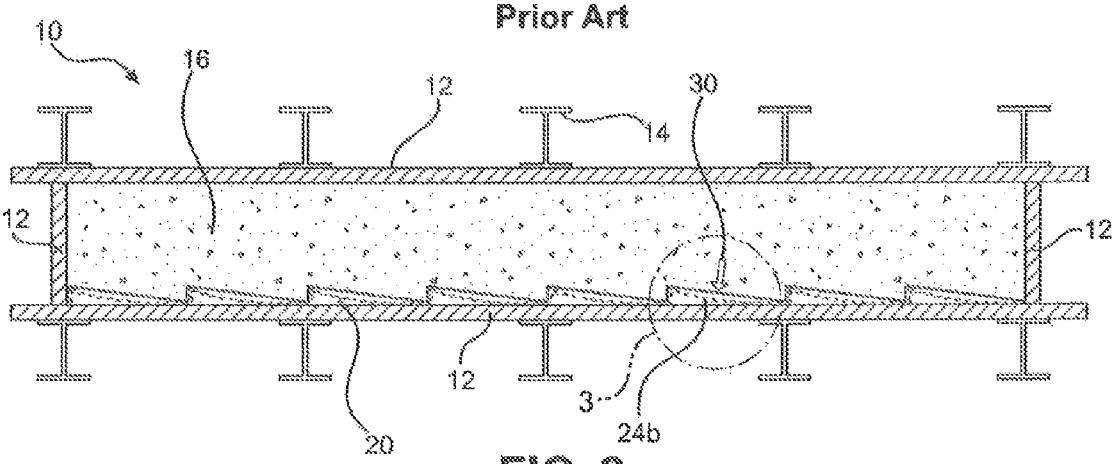
FIG. 2 Prior Art
FIG. 2 is a cross-sectional view taken along line 2-2 of FIG. 1, showing the prior art form having a sawtooth pattern form liner installed within and a detail of the deflection of the sawtooth pattern form liner due to the pressure of the concrete.
Figure 3:
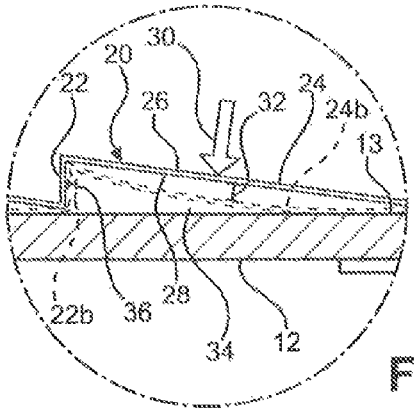
FIG. 3 is a close-up view of the cross-sectional view of FIG. 2 taken along line 2-2 of FIG. 1 showing the prior art form having a sawtooth pattern form liner installed within and a detail of the deflection of the sawtooth pattern form liner due to the pressure of the concrete.

Referring now to FIG. 2, in conjunction with FIG. 3, a cross-sectional view of the form system 10 taken along line 2-2 of FIG. 1 is shown. To form a textured concrete surface, form liners 20 are attached to the sheathing 12. The form liner 20 is placed inside the form system 10 and mounted to the inferior surface 13 of the sheathing 12 with screws, glue, or industrial tape. Concrete 16 is poured into the mold created by the sheathing 12 and comes into contact with the form liner 20. As the concrete 16 cures, the concrete wall 50 will hold the shape of the mold and have a textured surface with the pattern of the form liner 20. The outer surface or sheathing 12, made of plywood, sheet metal or other relatively flat material is supported by the supports 14, made of I-beams, wailers, or other structure, creating a rigid perimeter to provide structure to withstand the pressure of the concrete 16 poured within.

The cross-section 2-2 of the form system 10 is taken at a lower depth where greater pressures are exerted on the posterior surface 26 of the form liner 20. Concrete is a very dense material and in its fluid form exerts a tremendous amount of pressure. In its fluid form, the pressure exerted by the concrete increases with depth. The highest point of the form experiences the least amount of pressure and the lowest point of the form experiences the highest pressure. Due to the pressure profile of the concrete, the form liner 20 experiences different forces along its height.

The effect of the increase in pressure at the lower depth results in a deflection 32 in the form liner 20. The deflection 32 results from the recess 34 between the interior surface 13 of the sheathing 12 and the anterior surface 28 of the form liner 20. Specifically, the form liner 20 is constructed having a sawtooth pattern having a vertical member 22 and a horizontal member 24. The vertical member 22 is substantially perpendicular with the interior surface 13 of the sheathing 12 whereas the horizontal member 24 is angled from the top of the vertical member 22 to the interior surface 13 of the sheathing 12. The horizontal member 24 is unsupported as it spans from the vertical member 22 to the sheathing 12. This provides a large unsupported surface area in which the concrete 16 contacts and exerts its force 30. The horizontal member 24 of the form liner 20 is subject to deflection 32 into the recess 34 due to the force 30 of the concrete 16. Should deflection 32 occur, deformation 24*b* (shown in dashed lines) of the horizontal member 24 of the form liner 20 occurs. With enough force 30, the vertical member 22 will buckle 36 and deform 22*b* (shown in dashed lines). When deflection and buckling occurs, the resulting concrete surface will bulge out further than what was designed or intended. The resulting defect is readily visible, usually undesired and can result in the necessity to demolish and re-pour the wall at great expense and time delay.

Currently, the remedy to form liner deformation due to deflection and buckling is to cut wood or foam shapes which fit within the recess 34 to provide support to counter the force 30 of the concrete 16 mixture. This is a labor-intensive method and, in some cases, can cost more than the form liner 20 used on the job. This defeats the purpose of using form liner 20 because the purpose of using form liner 20 is to repeat a pattern or design easily and quickly by placing textured sheets or panels adjacent to one another in a form system 10 without having to actually perform work on every square foot of wall to be poured. The present invention solves this problem by supporting the recesses 34 and maintaining the ease of use of a form liner 20 panel while adding very minimal, if any, extra labor to the process.

Figure 4:
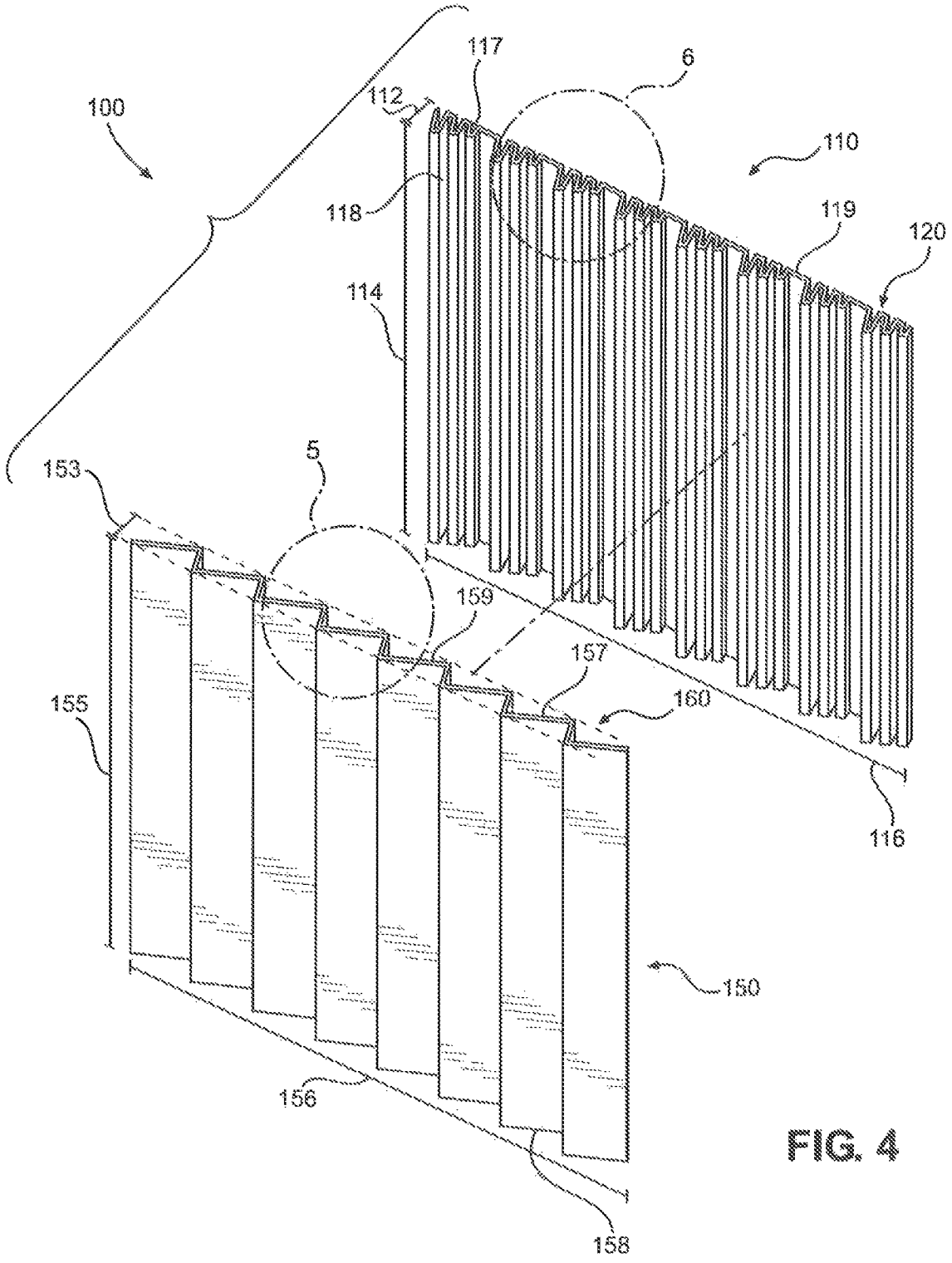
FIG. 4 is an exploded view of the form liner backer panel system of the present invention having a form liner and a backer panel.

Referring now to FIG. 4, an exploded view of the preferred embodiment of the form liner backer panel system is shown and generally designated 100. The form liner backer panel system 100 includes a backer panel 110 and a form liner 150. The form liner 150 has an anterior surface 157 and posterior surface 158 and is formed with protrusion geometry 159. In the preferred embodiment, the protrusion geometry 159 is a repeating sawtooth pattern with a plurality of identical sawtooth sections 160. The form liner 150 is formed as a sheet with a length 156, a height 155 and a width 153. The backer panel 110 has an anterior surface 117 and posterior surface 118 and is formed with a protrusion geometry 119. In the preferred embodiment, the protrusion geometry 119 is a repeating sawtooth pattern with a plurality of sawtooth where each sawtooth is formed as a protrusion section 120. The backer panel 110 is formed into a sheet with a length 118, a height 114 and a width 112.

Figure 5:
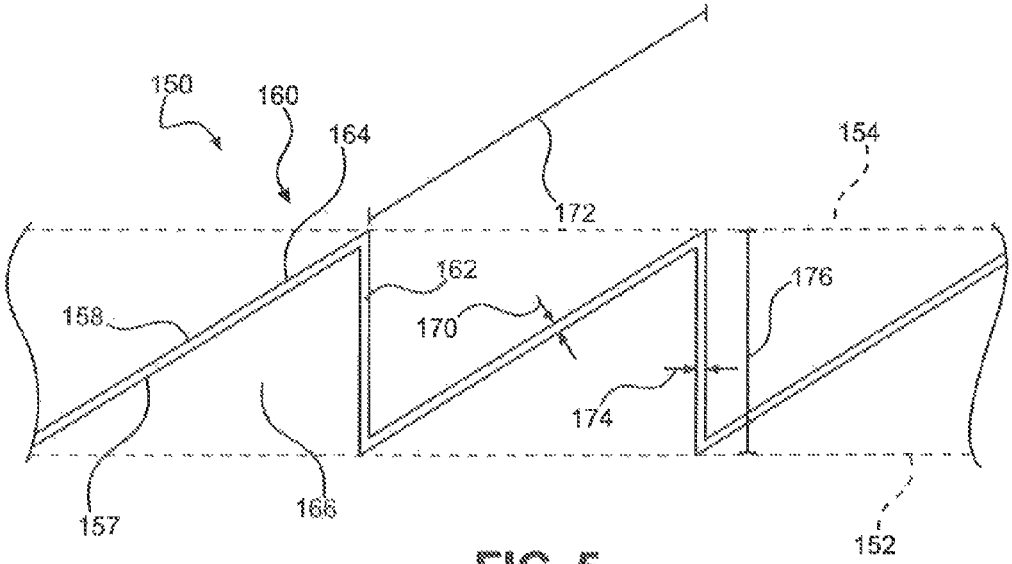
FIG. 5 is a top plan view of the form liner showing the sawtooth pattern.

The sawtooth section 180 of the form liner 150, described in conjunction with FIG. 5, includes a vertical member 182 and a horizontal member 184. The horizontal member 184 has a thickness 170 and a width 172. The vertical member 182 has a thickness 174 and a height 178. The vertical member 162 extends substantially vertically between a lower plane 152 (shown by dashed lines) and an upper plane 154 (shown by dashed lines). The horizontal member 164 is angled from the top of the vertical member 162 to the lower plane 152. The sawtooth section 160 is then repeated to form the protrusion geometry 159 as a sawtooth pattern for the form liner 150. The horizontal member 164 is unsupported as it spans from the vertical member 162 to a subsequent vertical member 162 of the next sawtooth section 160, creating a recess 168 under the horizontal member 164. As described above in conjunction with FIGS. 1 and 2, this provides a large unsupported surface area where excess pressure subjects the horizontal member 164 to deflection. The horizontal member 164 of the form liner 150 is subject to deflection. As a flat sheet, the strength analysis of the horizontal member 164 may be simplified as a model of a beam fixed at two points. The force that the horizontal member 164 can withstand before deflection is a function of its material properties, width 172 and thickness 170. The greater the width 172 and the smaller the thickness 170, the less force the horizontal member 164 will be able to withstand before deflecting. The backer panel 110 of the form liner backer panel system 100 is utilized to prevent deflection in the form liner 150.

Figure 6:
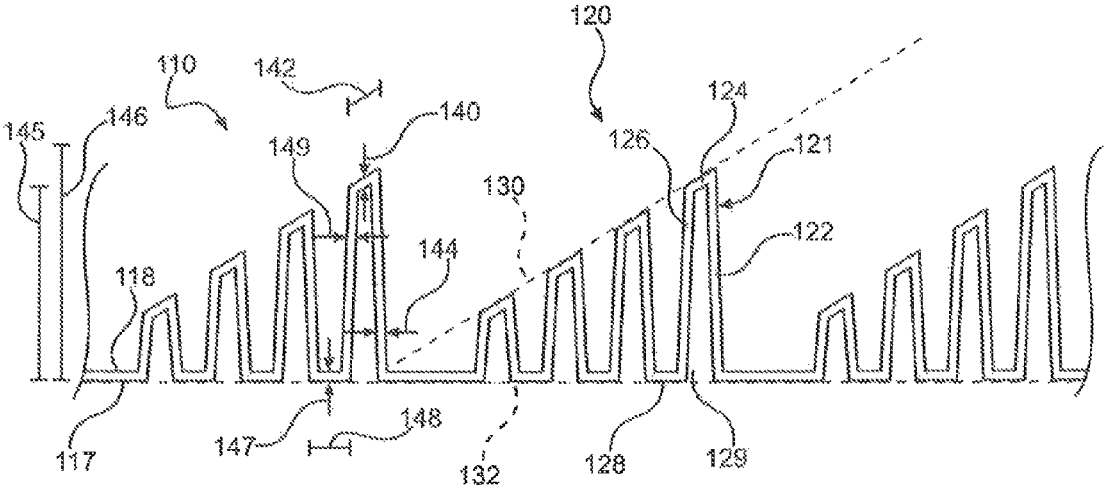
FIG. 6 is a top plan view of the backer panel having a sawtooth pattern with a plurality of protrusions making up each sawtooth.

The protrusion section 120 of the backer panel 110, described in conjunction with FIG. 6, includes a plurality of protrusions 121 forming a rectangular wave pattern. Each protrusion 121 has a first vertical member 122, a first horizontal member 124, a second vertical member 128 and a second horizontal member 128. The first vertical member 122 has a thickness 144 and a height 146, the second vertical member 126 has a thickness 149 and a height 145 less than height 146, the first horizontal member 124 has a thickness 140 and a width 142, and the second horizontal member 128 has a thickness 147 and a width 148. The first vertical member 122 and the second vertical member 126 are connected at the top by first horizontal member 124, thereby providing the first horizontal member 124 as a platform to support forces. The first vertical member 122 and second vertical member 126 serve as supports for the first horizontal member 124. The second horizontal member 128 connects the second vertical member 126 to a subsequent first vertical member 122 of a subsequent protrusion 121, with the plurality of protrusions 121 repeating to form the protrusion section 120.

The dimensions of each protrusion 121 is restrained within an upper plane 130 (shown by dashed lines) and a lower plane 132 (shown by dashed lines), wherein the upper plane 130 is defined by the horizontal member 164 of the form liner 150 and the lower plane 132 is defined by the lower plane 152 of the form liner 150 plus the thickness 147. The upper plane 130 is formed at an angle which results in the first horizontal member 124 of each protrusion 121 to be oriented at the same angle. This allows the first horizontal member 124 of each protrusion 121 to mount flush with the horizontal member 164 of the form liner 150. Additionally as shown, the protrusion section 120 includes four (4) protrusions with each subsequent protrusion 121 located to the left decreasing in overall height. By restraining and confining the protrusions 121 of the protrusion section 120, it ensures the protrusion section 120 of the backer panel 110 fits within the recesses 166 of the form liner 150 to provide structural support to resist buckling and deflection.

The vertical member 122 and vertical member 126 of the backer panel 110 are subject to buckling as vertically oriented members. As vertically oriented members, the strength analysis of the vertical member 122 and vertical member 126 may be simplified as a model of a vertical column fixed at two points. The force that the vertical members can withstand before buckling is a function of its material properties, geometrical cross-section, height and thickness. With material properties and geometrical cross-section the same as the horizontal member 164 of the form liner 150, the greater the thickness 144 and 149 and the smaller the height 146 and 145 for vertical members 122 and 126, respectively, the greater the force they will be able to withstand before buckling. Each subsequent vertical member decreases in height thereby increasing the axial force it may withstand before buckling. Additionally, the plurality of first vertical members 122 and the second vertical members 126 of protrusion section 120 spread the forces among the plurality of first vertical members 122 and the second vertical members 126 evenly, thereby decreasing the amount of force each vertical member experiences.

As shown, the form liner 150 and the backer panel 110 are large sheets with distinct protrusion geometry 159 and 119, respectively. The form liner 150 is a sheet having the protrusion geometry 159 of a sawtooth pattern and the backer panel 110 is a sheet having the protrusion geometry 119 of a sawtooth pattern with multiple protrusions in the form of a rectangular wave making up a sawtooth. The backer panel 110 is dimensioned to fit within the recesses 166 of the form liner 150 where the posterior surface 118 of the backer panel 110 is adjacent the anterior surface 157 of the form liner 150. The first horizontal member 124 of the protrusions 121 of the backer panel 110 is adjacent to the anterior surface 157 of the form liner 150 and the second horizontal member 128 of the protrusions 121 of the backer panel 110 is adjacent to the interior surface 13 of the sheathing 12 of the form system 10. The first vertical member 122 and second vertical member 126 spans between the first horizontal member 124 and second horizontal member 128 to transfer the force 30 of the concrete 16 from the horizontal member 164 of the form liner 150 to the more rigid sheathing 12. The backer panel provides a rigid structural frame to prevent the form liner 150 from buckling and deflecting under pressure.

The form liner 150 and the backer panels 110 may be, in a preferred embodiment, formed as extruded sheets having protrusion geometry 159 and 119, respectively. Alternatively, form liner 150 and the backer panel 110 may be formed by corrugating a material into the desired protrusion geometry 159 and 119, respectively. The form liner 150 and backer panel 110 may be made of, but not limited to, plastic, elastomeric, semi-elastomeric urethane or any other material or combination of materials.

The pattern, shape and geometry of the form liner 150 and backer panel 110 is not meant to be limiting and various different patterns, shapes and geometries may be used for the form liner 150 and backer panel 110. In order to provide virtually unlimited aesthetic choices for a concrete surface, the form liner 150 may be varied and include, but not limited to, fluted patterns, fin patterns, brick patterns, block patterns, wood grain patterns, textured patterns and other custom patterns. The backer panel 110 pattern may be made of various shapes such as cylindrical, tubular, triangular, spherical, conical, hexagonal pyramids or any other shape which may be utilized to provide a structure to support multidimensional forces. The backer panel 110 pattern will be made to conform within an envelope defined by the pattern, shape and geometry of the form liner 150 wherein the resulting protrusions of the backer panel 110 are contiguous to the anterior surface 157 of the form liner 150 and are contiguous to the interior surface 13 of the sheathing 12 of the form system 10. Other form finer patterns could have differently shaped backer panel support structures, as long as the purpose of supporting the form liner is achieved. It is also contemplated that the backer panel 110 may be constructed to fit currently existing form liners.

Figure 7:
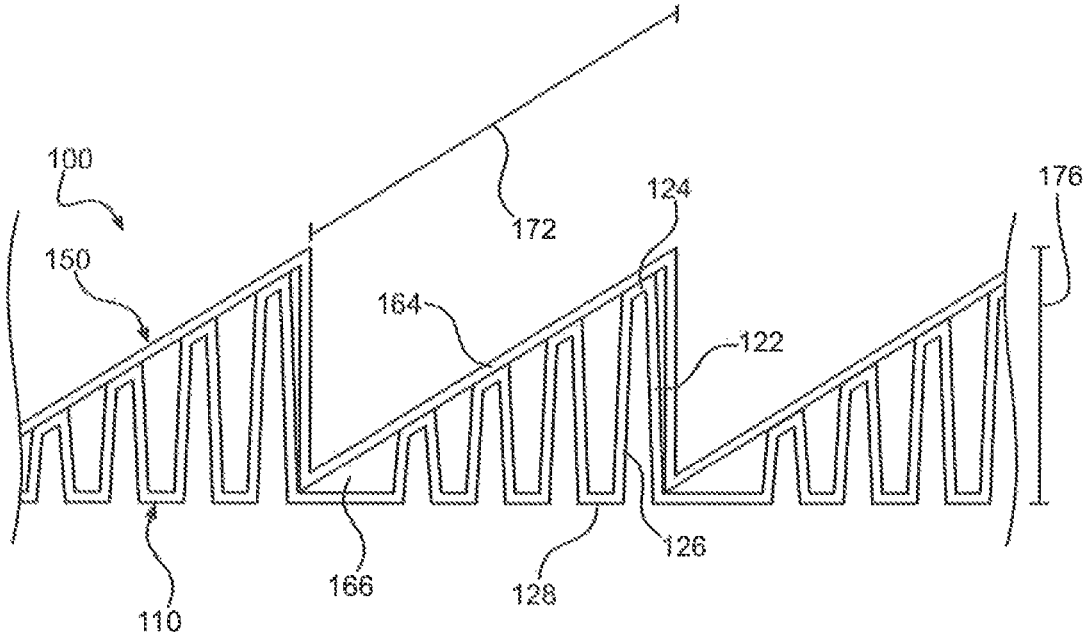
FIG. 7 is a top plan view of the backer panel received by the form liner, wherein the protrusions section of the backer panel creates a rigid frame structure to support the form liner thereby increasing the strength of the form liner backer panel system.

Referring now to FIG. 7, a top plan view of the form liner backer panel system 100 is shown with the backer panel 110 received by form liner 150 thereby creating a rigid frame structure able to resist buckling and deflection caused by the pressures of concrete. Insertion of the backer panel 110 into the recesses 166 of the form liner 150 provides the form liner 150 with a rigid frame structure to adequately support the form liner 150 from the pressures exerted by the concrete.

As discussed above in conjunction with FIGS. 5 and 6, the horizontal member 164 of the form liner 150 without the rigid frame structure provided by the backer panel 110 is subject to buckling and deflection. The horizontal member 164 has low pressure handling capacity due to its relatively long width 172 compared to its thickness 170. When inserted, the backer panel 110 provides the horizontal member 164 of the form liner 150 with a rigid support frame to support the horizontal member 164 and prevent it from buckling and deflecting. Each protrusion section 120 of the backer panel 110 provides each sawtooth section 160 of the form liner 150 with eight (8) vertical members to withstand the pressures exerted by the concrete. The plurality of vertical members of the backer panel transfers the force exerted onto the form liner 150 by the concrete 16 to the sheathing 12 of the form system 10. The form system 10 is typically built to withstand many times the amount of pressures exerted by the concrete in order to ensure adequate strength and durability. As a result, the form system 10 can withstand the forces transferred by the backer panel 110 from the form liner 150 without any deflection, ensuring that the form liner 150 will form a proper and as specified textured concrete surface.

It is also contemplated that the backer panel 150 may be utilized only at sections of the form liner 150 susceptible to buckling and deflection due to the pressures exerted by the concrete. In particular, the backer panels 110 may be utilized at lower elevations of the form liner 150 to support the higher pressures of the concrete and not utilized at higher elevations as the pressures are lower. At higher elevations, the form liner 150 may provide adequate structural strength to withstand the pressures of the concrete at that particular area. The resulting backer panel 110 will have areas with protrusions and areas without as determined to support the areas of the form liner 150 which need additional support.

Due to the rigid frame structure provided by the backer panel 110, the form liner 150 may have more liberties in its design and manufacture. As mentioned above, a design consideration when constructing form liners 150 is its structural strength. This leads to using heavier, more rigid materials, larger thicknesses and designs having inherent structural stiffness resulting in heavy and bulky form liners 150 which may be difficult to handle and use. With the backer panel 110, the structural strength of the form liner 150 may be minimized as a design constraint. The backer panel 110 prevents deformation of the form liner 150 through buckling and deflection. This will allow form liners 150 to be manufactured with a thinner thickness, larger widths, and more complex designs as the backer panel 110 will provide structural support to the form liner 150. The lighter form liner 150 will also be easier to handle and use.

Figure 8:
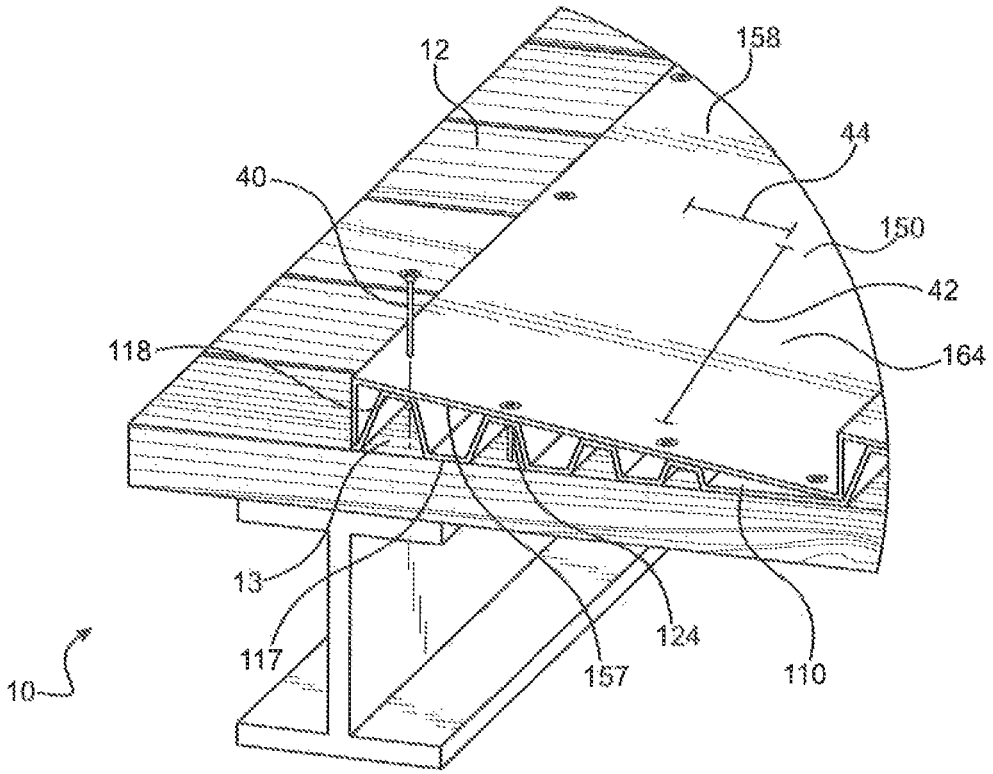
FIG. 8 shows a perspective detailed view of the attachment method for the form liner and backer panel of the present invention.

Referring now to FIG. 8, a perspective detailed view of the form system 10 fitted with the form liner backer panel system 100 is shown. The figure shows a cutaway detailed view of an attachment method for mounting the backer panel 110 and form liner 150 to the sheathing 12 of form system 10. The material and structure of the form liner 150 and backer panel 110 results in lightweight and rigid components for easy handling and installation.

The backer panel 110 is fitted within the form liner 150 and both are placed against the sheathing 12. The backer panel 110 is fitted within the recesses 166 of the form liner 150 where the posterior surface 118 of the backer panel 110 is adjacent to and contacts the anterior surface 157 of the form liner 150. The form liner 150 covers the posterior surface 118 of the backer panel 110 creating the form liner backer panel system 100. The form liner backer panel system 100 has the anterior surface 117 of the backer panel 110 exposed and the posterior surface 158 of the form liner 150 exposed. Once assembled, the form liner back panel system 100 is placed against the interior surface 13 of sheathing 12 at a predetermined location. The anterior surface 117 of the backer panel 110 is adjacent to and flush with the interior surface 13 of the sheathing 12 and the posterior surface 158 of the form liner 150 is exposed to the interior of the form system 10.

Once in position, a countersink type screw 40 is driven through the horizontal members 164 and 124 of the form liner 150 and backer panel 110, respectively. The screw 40 is tightened just enough so that the screw head of screw 40 sits flush with the surface of the form liner 150. Each screw is spaced a perimeter distance 42 or interior distance 44 apart from a subsequent screw. The screws 40 are typically spaced perimeter distance 42 twelve (12) inches apart around the perimeter of the form liner 150 and the interior distance 34 twelve (12) inches-eighteen (18) inches apart throughout the rest of the form liner 150. The length of screw 40 should be chosen so that there is sufficient length to cover the distance from the posterior surface 158 of the form liner 150 to the sheathing 12, with enough extra length so as to sufficiently penetrate into the sheathing 12. Alternatively, the form liner 150 and backer panel 110 may be attached to the sheathing 12 with the use of screws, glue, industrial tape or various other removable attachment means known in the art.

Upon completion of the concrete wall with textured surface, the steps are reversed to remove the form liner 150 and backer panel 110. The screws 40 are removed to detach the form liner backer panel system 100 from sheathing 12. Once all the screws 40 are removed, the form liner backer panel system 100 is taken apart from the sheathing 12 as a whole or in parts. Specifically, the form liner backer panel system 100 may be removed and disassembled later or the form liner 150 may be removed from the sheathing 13 first, followed by the backer panel 110. Once the form liner 150 and back panel 110 are separated, the form liners 150 and backer panels 110 may be stacked in their relative groups. The recesses and protrusions of the backer panel 110 allow a subsequent backer panel 110 to be stacked. The form liner 150 can be stacked in a similar manner as well. This allows for compact storage and easier mobility of the form liner backer panel system 100.

Figure 9:
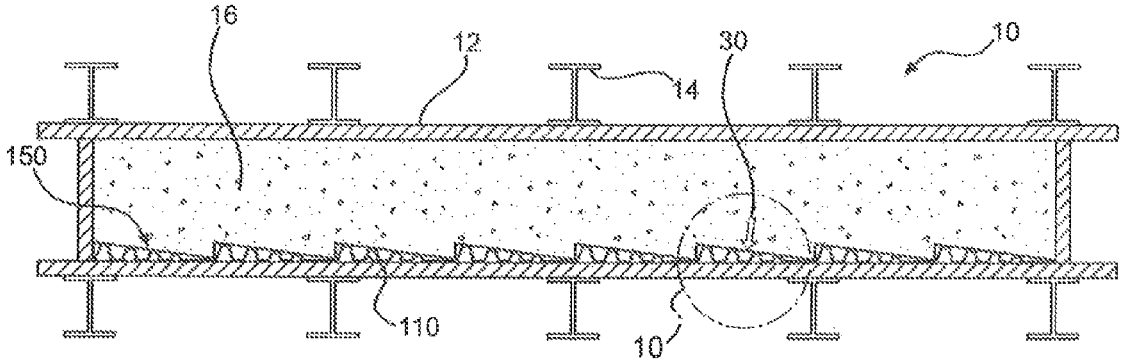
FIG. 9 shows a top plan view of a prior art form having the form liner backer panel system of the present invention installed within, the form liner having a sawtooth pattern and the backer panel installed between the sawtooth form liner and the prior art form surface.
Figure 10:
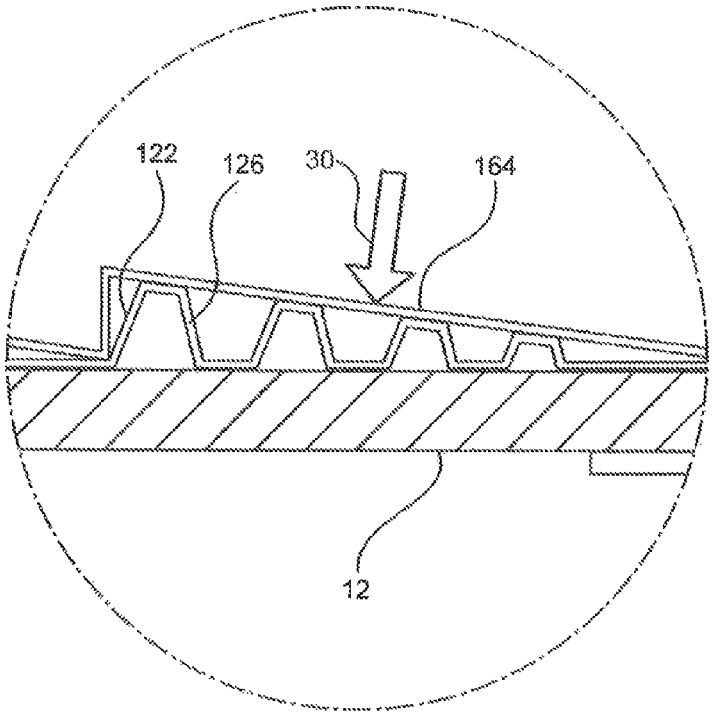
FIG. 10 is a close-up view of the top plan view shown in FIG. 9 of the prior art form having the form liner backer panel system of the present invention installed within, the form liner having a sawtooth pattern and the backer panel installed between the sawtooth form liner and the prior art form surface.

Referring now to FIG. 9, in conjunction with FIG. 10, a top plan view of the form liner backer panel system 100 utilized in form system 10 to create a concrete wall with textured surface is shown. The force 30 of the concrete 16 is met by the vertical members provided by the protrusion sections 120 of backer panel 110. The backer panel 110 supports the form liner 150 and prevents buckling and deflection creating a true-to-form concrete wall with textured surface. The backer panel 110 is utilized to fully support the form liner 150.

Figure 11:
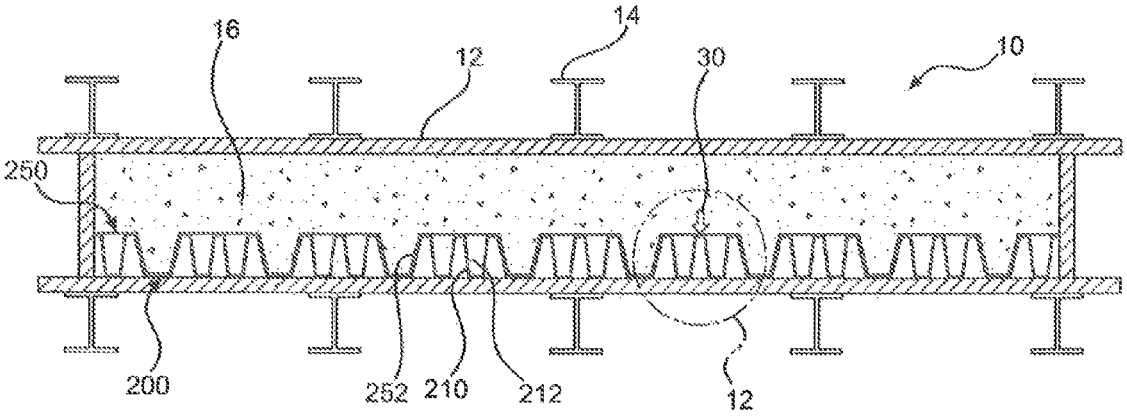
FIG. 11 shows a top plan view of a form having an alternative embodiment of the form liner backer panel system of the present invention installed within, the form liner having a fluted rib pattern and the backer panel Installed between the fluted rib form liner and the form surface.
Figure 12:
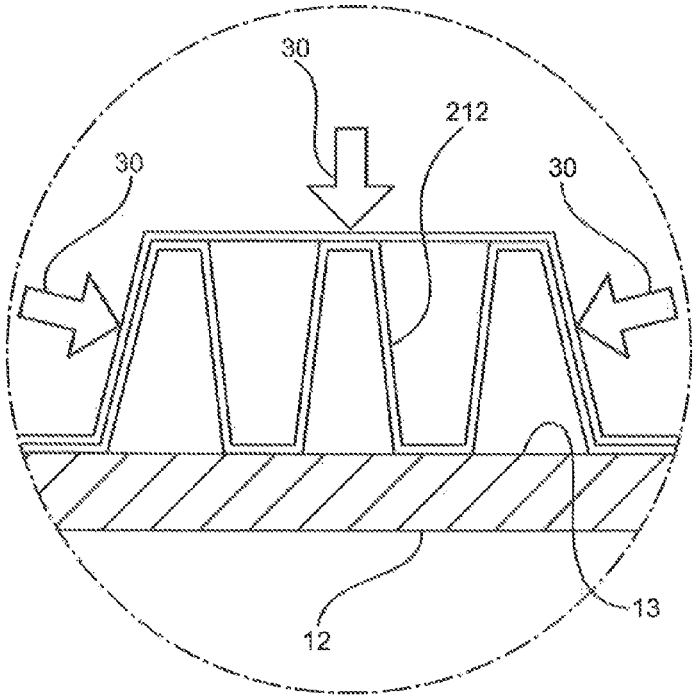
FIG. 12 shows a top plan view of FIG. 11 of the form having an alternative embodiment of the form liner backer panel system of the present invention installed within, the form liner having a fluted rib pattern and the backer panel installed between the fluted rib form liner and the form surface.

Referring now to FIG. 11, in conjunction with FIG. 12, a top plan view of an alternative embodiment of the form liner backer panel system of the present invention is shown and generally designated 200. FIG. 11 illustrates the form system 10 containing an alternative embodiment of a form liner 250 having a pattern commonly known as a smooth flute. The backer panel 210 has a series of smaller flutes 212 to support the larger flutes 252 of the form liner 250. Similar to form liner 150 and backer panel 110 described above, the smaller flutes 212 of the backer panel 210 are contiguous to the posterior of the form liner 250 and are contiguous to the interior surface 13 of the sheathing 12 of the form system 10, providing support to resist the urging of the form liner 250 to deflect and buckle under pressure. The protrusions of the smaller flutes 212 of the backer panel 210 provide structural protrusions to support the form liner 250 from deflecting and buckling under excessive pressure.

Figure 13:
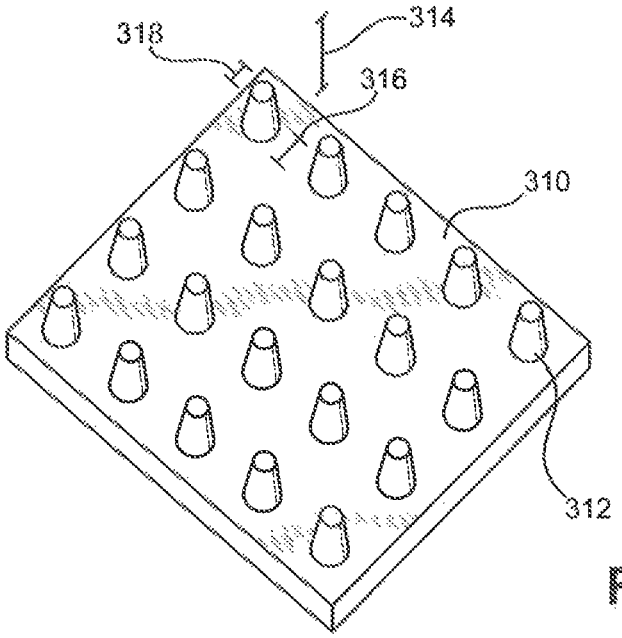
FIG. 13 shows a perspective view of an alternative embodiment of a backer panel having truncated cone protrusions.

Referring now to FIG. 13, an alternative embodiment of the backer panel is shown and generally designated 310. The backer panel 310 is manufactured with a plurality of protrusions in the shape of truncated cones 312. The truncated cones 312 vary in height 314 and tapers from a base diameter 316 to a truncated diameter 318. The dimensions of the truncated cone 312 may be modified to fit a particular form liner 150 to provide a rigid structural frame to prevent the form liner 150 from deformation due to buckling and deflection.

Figure 14:
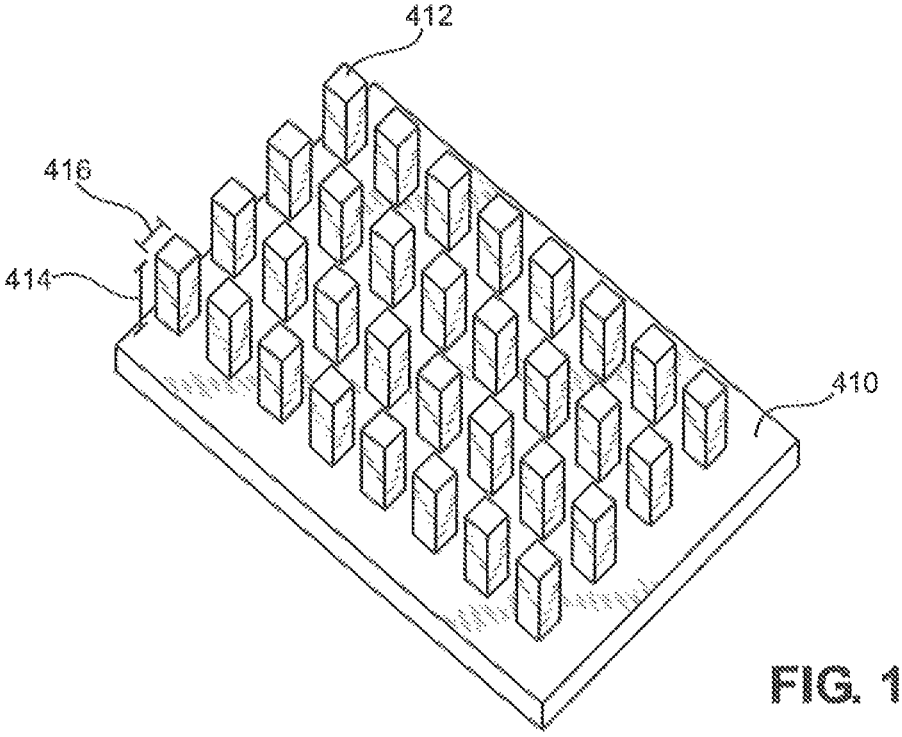
FIG. 14 shows a perspective view of an alternative embodiment of a backer panel having rectangular tube protrusions.

Referring now to FIG. 14, an alternative embodiment of the backer panel is shown and generally designated 410. The backer panel 410 is manufactured with a plurality of protrusions in the shape of rectangular tubes 412. The rectangular tubes 412 vary in height 414 and width 416. The dimensions of the rectangular tube 412 may be modified to fit a particular form liner 150 to provide a rigid structural frame to prevent the form liner 150 from deformation due to buckling and deflection.

While the form liner backer panel system 100 of the present invention as herein shown and disclosed in detail is fully capable of obtaining the objects and providing the advantages herein before stated, if is to be understood that it is merely illustrative of preferred and alternative embodiments of the invention and that no limitations are intended to the details of construction or design herein shown other than as described in the appended claims.

I claim:

1. A form liner backer panel system, comprising:

a form liner having an anterior surface and a posterior surface, said form liner formed with a protrusion geometry creating a plurality of protrusions in the form liner:

a backer panel having an anterior surface and a posterior surface and formed with a protrusion geometry comprising a plurality of patterned sections having a plurality of protrusions, wherein the protrusions of each patterned section are formed to be received within a single protrusion of the form liner; and wherein the backer panel is positioned between the form liner and a form system having an interior surface and whereby the backer panel posterior surface is contiguous to the form liner anterior surface and the backer panel anterior surface is contiguous to the form system interior surface.

2. The form liner backer panel system of claim 1, wherein the form liner covers the backer panel.

3. The form liner backer panel system of claim 1, wherein the protrusions of the backer panel are configured to receive the protrusions of an adjacent backer panel.

4. The form liner backer panel system of claim 1, wherein the backer panel is removably attached to the form liner.

5. The form liner backer panel system of claim 1, wherein the protrusion geometry of the form liner is a sawtooth pattern.

6. The form liner backer panel system of claim 1, wherein each of the protrusions of the form liner is a smooth flute and each of the protrusions of the backer panel is a smooth flute.

7. A form liner backer pane system, comprising:

a form liner formed as a sheet with an anterior surface and a posterior surface, said sheet having a protrusion geometry forming a plurality protrusions in the sheet;

a backer panel formed as a sheet with an anterior surface and a posterior surface, said sheet having a protrusion geometry forming a plurality of patterned sections having a plurality of protrusions in the sheet, wherein the protrusions of each patterned section of the backer panel are formed to be received within a single protrusion of the form liner; and wherein the backer panel is placed between the form liner and a form system having an interior surface, whereby the backer panel posterior surface is contiguous to the form liner anterior surface and the backer panel anterior surface is contiguous to the form system interior surface.

8. The form liner backer panel system of claim 7, wherein the form liner covers the backer panel.

9. The form liner backer panel system of claim 7, wherein the protrusions of the backer panel are configured to receive the protrusions of an adjacent backer panel.

10. The form liner backer panel system of claim 7, wherein the backer panel is removably attached to the form liner.

11. The form liner backer panel system of claim 7, wherein the protrusion geometry of the form liner is a sawtooth pattern.

12. The form liner backer panel system of claim 7, wherein each of the protrusions of the form liner is a smooth flute and each of the protrusions of the backer panel is a smooth flute.

* * * * *